US006616073B2

(12) United States Patent
Sugiyama

(10) Patent No.: US 6,616,073 B2
(45) Date of Patent: Sep. 9, 2003

(54) FUEL INJECTION VALVE

(75) Inventor: Koichi Sugiyama, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/305,182

(22) Filed: Nov. 27, 2002

(65) Prior Publication Data

US 2003/0102388 A1 Jun. 5, 2003

(30) Foreign Application Priority Data

Nov. 30, 2001 (JP) ..... 2001-366704

(51) Int. Cl.[7] ..... B05B 1/30

(52) U.S. Cl. ..... 239/585.1; 239/DIG. 19; 239/585.4; 251/129.21

(58) Field of Search ..... 239/585.1–585.5, 239/DIG. 19; 251/129.15, 129.16, 129.21, 129.06

(56) References Cited

U.S. PATENT DOCUMENTS 5,996,910 A 12/1999 Takeda et al. ..... 1/1
6,201,461 B1 * 3/2001 Eichendorf et al. .... 251/129.15
6,405,947 B2 * 6/2002 Fotchman ..... 239/585.4
6,561,168 B2 * 5/2003 Hokao et al. ..... 123/557

* cited by examiner

*Primary Examiner*—Michael Mar
*Assistant Examiner*—Dinh Q. Nguyen
(74) *Attorney, Agent, or Firm*—Nixon & Vanderhye P.C.

(57) ABSTRACT

In a fuel injection valve in which an outer frame member is press fitted to a limited region of an outer circumference of an inner pipe member in a state that a drive coil is radially sandwiched therebetween, a valve lift amount is accurately adjusted by press fitting the attracting member to the inner pipe member without being adversely affected by a possible deformation of the inner circumference of the inner pipe member on press fitting the outer frame member to the inner pipe member due to a relief space provided in the inner circumference of the inner pipe member for preventing the outer circumference of the attracting member from contacting the inner circumference of the inner pipe member at least at a position just radially inside and axially corresponding to the limited region.

10 Claims, 7 Drawing Sheets

FUEL INJECTION VALVE

CROSS REFERENCE TO RELATED APPLICATION

This application is based upon and claims the benefit of priority of Japanese Patent Application No. 2001-366704 filed on Nov. 30, 2001, the content of which is incorporated herein by reference.

BACKGROUND OF THE INVENTION

1. Field of the Invention

The present invention relates to a fuel injection valve in which fuel injection amount is accurately adjusted.

2. Description of the Prior Art

To meet recent demands of higher performance and exhaust emission purification of an internal combustion engine, adjustable assembly of component parts is necessary to secure accurate injection amount of fuel to be sprayed from injection bores. Generally, in the fuel injection valve, in particular, in a fuel injection valve of the internal combustion engine for vehicles, a valve operative together with a movable member is driven to open and close the injection bores by permitting and interrupting current apply to a drive coil. An electric control unit is operative to govern a time period during which the current is supplied to the drive coil for controlling a valve-opening period so that the injection amount of fuel to be sprayed from injection bores to the engine is defined. Accurate fuel injection amount is achieved by absorbing manufacturing deviation or fluctuation of the component parts of the fuel injection valve, that is, the adjustable assembly of the component parts of the fuel injection valve has to be carried out for securing accurate injection amount of fuel to be sprayed from the injection bores.

For example, U.S. Pat. No. 5,996,910 discloses the adjustable assembly of component parts for securing the accurate fuel injection amount. According to U.S. Pat. No. 5,996,910, an attracting member is press fitted to an inner circumference of a pipe until an axial end of the attracting member reaches an axial given position of the pipe where a given lift amount of a nozzle needle is ensured.

In a conventional fuel injection valve disclosed in U.S. Pat. No. 5,996,910, pressing load necessary for press fitting the attracting member to the inner circumference of the pipe is variable depending on shape or geometry variation of the inner circumference of the pipe. For example, when component parts are connected to an outer circumference of the pipe by press fitting or welding, the inner circumference of the pipe is prone to be partially and unstably deformed by compression force due to the press fitting or thermal stress due to the welding, even if the respective component parts have accurate dimension before they are connected to the pipe by press fitting or by welding. Accordingly, when the attracting member is press fitted to the inner circumference of the pipe, a relative axial position between the attracting member and the pipe is not precisely predictable since a degree of the partial deformation of the inner circumference of the pipe is variable and the pressing load applied to the attracting member for press fitting is not stable.

To make the shape of the inner circumference of the pipe uniform, it is contemplated to finish the inner circumference of the pipe through a grinding or reaming process. However, this process needs more fabrication time and manufacturing cost.

SUMMARY OF THE INVENTION

An object of the present invention is to provide a fuel injection valve in which a valve lift amount is precisely adjusted to define an accurate fuel injection amount by press fitting an attracting member to an inner circumference of an inner pipe member, even if shape of a part of the inner circumference of the inner pipe member is not uniform due to an outer frame member connected to an outer circumference thereof.

To achieve the above object, in a fuel injection valve in which a valve member moves axially and reciprocatingly, an inner pipe member has first and second zones through which magnetic flux easily pass, respectively and a third zone through which magnetic flux hardly passes and which is positioned axially between the first and second zones. A drive coil is arranged around an outer circumference of the inner pipe member. An outer frame member is connected, for example, by press fitting or welding, to the outer circumference of the inner pipe member at first and second limited regions falling within the first and second zones, respectively, in such a manner that the drive coil is sandwiched radially between the outer frame member and the inner pipe member. An attracting member is press fitted to the inner circumference of the metal inner pipe member so that an axial end of the attracting member is positioned axially within the third zone and the other axial end thereof is positioned axially within the first zone. A movable member, whose axial end is connected to the valve member, is accommodated to move axially and reciprocatingly within an inner circumference of the inner pipe member. The axial end of the movable member is positioned axially within the second zone and the other axial end thereof is positioned axially within the third zone so that the movable member is axially away by a given distance from the axial end of the attracting member, when the drive coil is not energized, and attracted toward the axial end of the attracting member by magnetic flux passing through the outer frame member, the first zone, the movable member and the second zone, when the drive coil is energized.

With the fuel injection valve mentioned above, an outer circumference of the attracting member and/or the inner circumference of the inner pipe member is provided with a relief space which prevents the outer circumference of the attracting member from coming in contact with the inner circumference of the inner pipe member at least at a position just radially inside and axially corresponding to the first limited region.

Even if the inner circumference of the inner pipe member at the position axially corresponding to the first limited region is variably deformed by pressing force or thermal stress when the outer frame member is press fitted or welded to the outer circumference of the inner pipe member, the relief space prevents the outer circumference of the attracting member from coming in contact with the inner circumference of the inner pipe member at a position just radially inside and axially corresponding to the first limited region, when the pressing load is applied to the attracting member for press fitting the attracting member to the inner pipe member for a valve lift adjustment. Accordingly, an axial position of the attracting member relative to the inner pipe member is precisely adjusted by press fitting the attracting member to the inner pipe member so that a valve lift amount is accurately defined, since the relief space effectively absorbs the possible deformation of the inner circumference of the inner pipe member at the position axially corresponding to the first limited region.

It is preferable that the outer circumference of the attracting member is in contact with the inner circumference of the inner pipe member only at a position axially between the first and second limited regions. In more details, diameter of the inner circumference of the inner pipe member with which the outer circumference of the attracting member is not in contact in the first zone is larger than that of the inner circumference of the inner pipe with which the outer circumference of the attracting member is in contact. In this case, the attracting member is easily inserted and press fitted to the inner pipe member from an axial end of the first zone on a side remote from the third zone since it is not necessary to substantially press the attracting member to the inner pipe member until the axial end of the attracting member axially exceeds the first limited region in the first zone.

In addition, preferably, a diameter of the outer circumference of the attracting member in contact with the inner circumference of the inner pipe member is larger than that of the outer circumference of the attracting member not in contact with the inner circumference of the inner pipe member at least at a portion axially corresponding to the first limited region. In this case, not only the attracting member is more easily press fitted to the inner pipe member, but also the possible contact between the outer circumference of the attracting member and the inner circumference of the inner pipe member at the position axially corresponding to the first limited region can be more definitely avoided.

Further, instead of the relief space provided on a side of the inner circumference of the inner pipe member, the attracting member may be provided on and along the outer circumference thereof with an annular recess such as a groove, as a relief space, which prevents the outer circumference of the attracting member from coming in contact with the inner circumference of the inner pipe member at the position axially corresponding to the first limited region.

Furthermore, it is preferable that the fuel injection valve has an adjusting pipe press fitted to an inner circumference of the attracting member and a spring disposed at least partly within the inner circumference of the attracting member and sandwiched axially between the movable member and the adjusting pipe for urging the movable member axially in a direction away from the attracting member.

With this valve, if the relief space provided on the outer circumference of the attracting member is positioned axially in a middle of the adjusting pipe press fitted to the inner circumference of the attracting member and diameters of the outer circumference of the attracting member axially outside the relief space are equal to each other, the relief space not only prevents the outer circumference of the attracting member from coming in contact with the inner circumference of the inner pipe member at a position axially corresponding to the first limited region but also serves to keep an adequate stiffness of the attracting member to an extent that the adjusting member is precisely press fitted to the inner circumference of the attracting member.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

Preferred embodiments of the present invention are described with reference to drawings.

(First embodiment)

Figure 1:
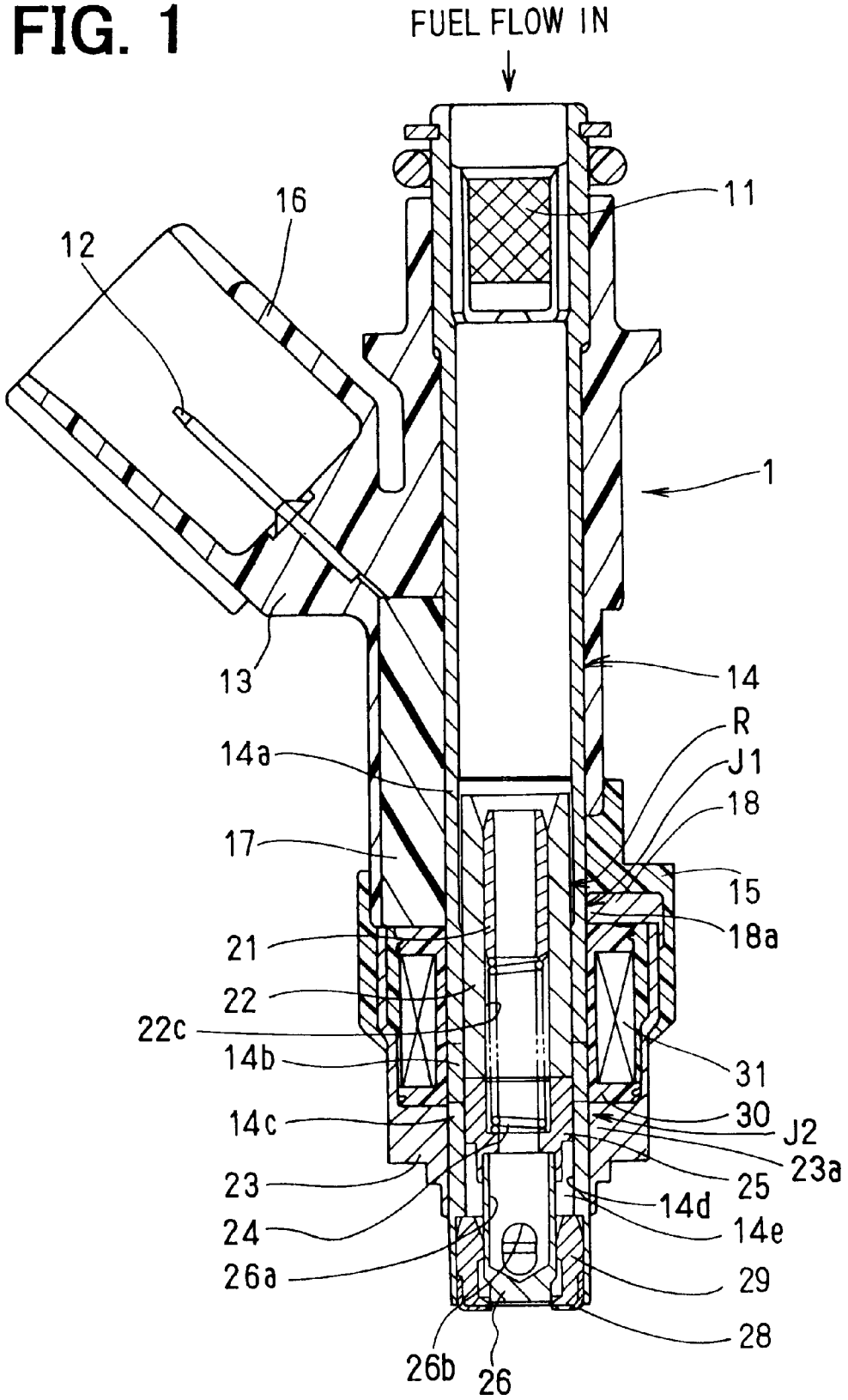
FIG. 1 is a cross sectional view of an outline of a fuel injection valve according to a first embodiment of the present invention.
Figure 2:
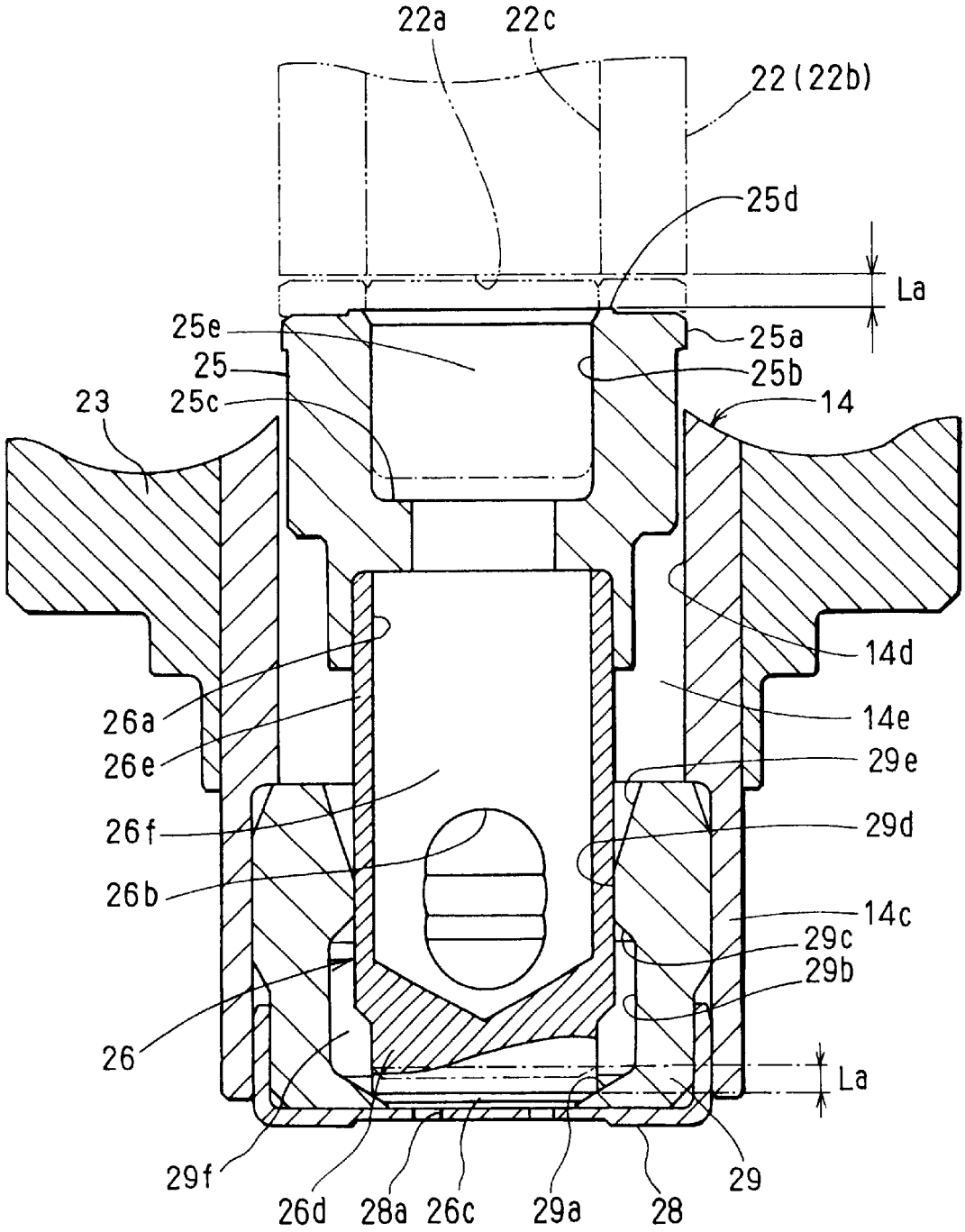
FIG. 2 is a cross sectional part view of the fuel injection valve of FIG. 1 showing a valve member.
Figure 3:
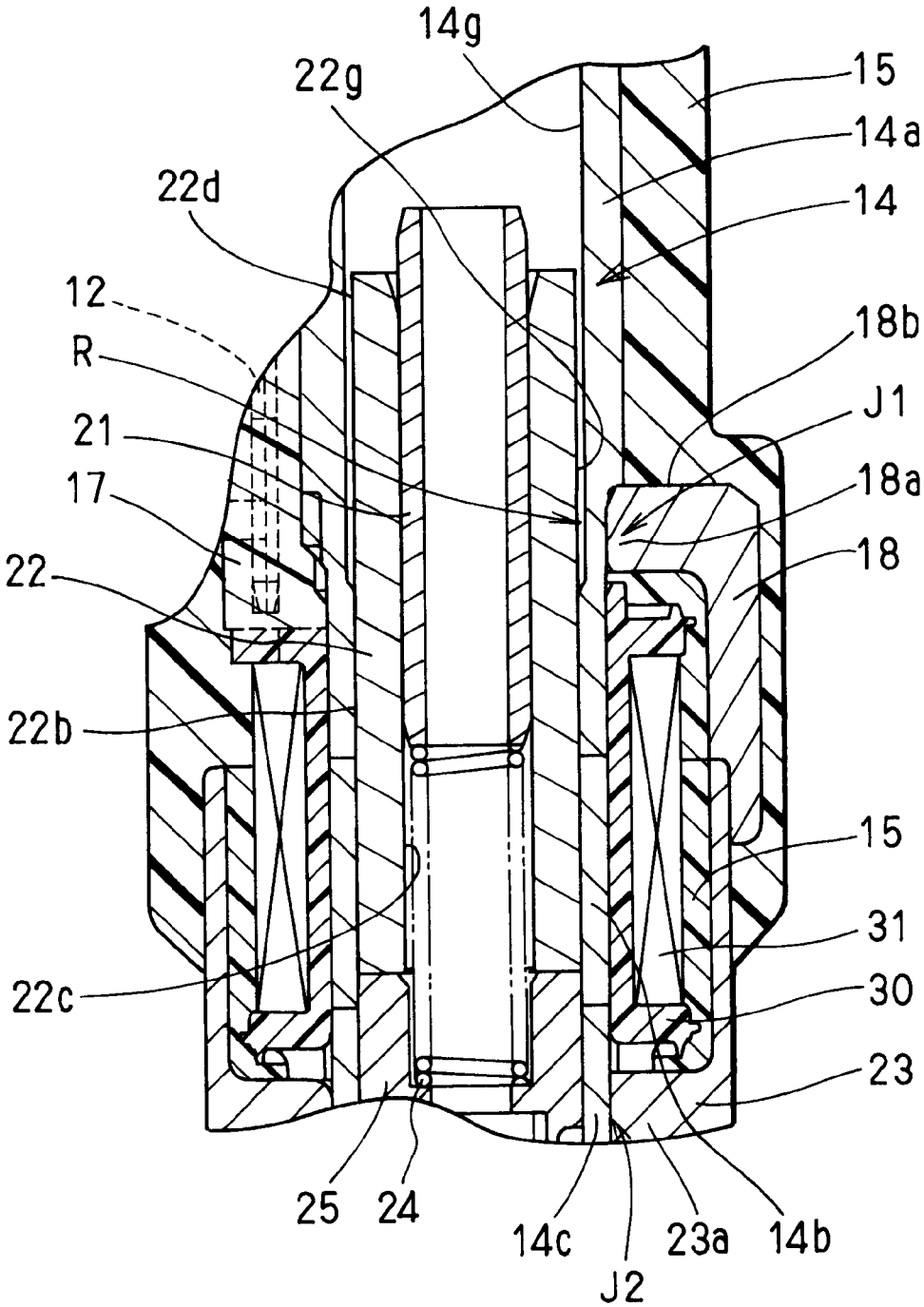
FIG. 3 is across sectional part view of the fuel injection valve of FIG. 1 showing an attracting member press fitted to a metal inner pipe member for defining a lift amount of the valve member.

As shown in FIGS. 1, 2 and 3, a fuel injection valve 1 is a valve installed in an intake manifold of an internal combustion engine, in particular, a gasoline engine for injecting fuel to be supplied to a combustion chamber of the internal combustion engine. The fuel injection valve 1 is formed substantially in cylindrical shape. The fuel injection valve 1 is composed of a valve portion B and an electromagnetic drive portion S. The valve portion B has a valve body 29 and a valve member (a nozzle needle) 26. The electromagnetic drive portion S has a drive coil 31 composed of a spool 30 and a coil wound thereon, metal outer frame members 18 and 23 constituting a magnetic circuit through which magnetic flux flows based on magnetic force generated upon energizing the coil 31, and an armature 25 as a movable element movable axially due to an attracting force based on the magnetic flux.

The valve body 29 is bonded to an inner circumference of a metal inner pipe member 14 by welding. In more details, as shown in FIG. 2, after the valve body 29 is press fitted or inserted to the inner circumference of a magnetic material pipe 14*c* of the metal inner pipe member 14, the valve body 29 is welded to an entire circumference of the magnetic material pipe 14*c* from a side of an outer circumference thereof.

As shown in FIG. 2, a fuel passage through which fuel is injected to the internal combustion engine is formed inside an inner circumference of the valve body 29. The valve body 29 is provided at the inner circumference thereof with a conical surface as a valve seat 29*a* on which the nozzle needle 26 is seated or unseated, a large diameter cylindrical wall surface 29*b*, a conical surface 29*c*, a small diameter cylindrical wall surface 29*d* which holds slidably the nozzle needle 26 and a conical surface 29*e*, which are arranged in order from downstream of the fuel passage to upstream thereof. An inner diameter of the conical surface (valve seat) 29*a* is smaller toward the downstream of the fuel passage. A contact portion 26*c* of the nozzle needle 26 comes in contact with or leaves from the valve seat 29*a* so that the valve portion B performs a valve closing or opening operation for blocking or allowing flow of fuel to be injected. A ring space between the nozzle needle 26 and the large diameter cylindrical wall surface 29*b* forms a fuel sump chamber 29*f*. An inner diameter of the small diameter cylindrical wall surface 29*d* is smaller than that of the large diameter cylindrical wall surface 29*b*. An inner diameter of the conical surface 29*e* is larger toward the upstream of the fuel passage.

Together with the inner circumference of the metal inner pipe member 14, whose details will be described later, the valve seat 29*a*, the large diameter cylindrical wall surface 29*b*, the conical surface 29*c*, the small diameter cylindrical wall surface 29*d* and the conical surface 29*e* form a guide hole in which the nozzle needle 26 is accommodated The nozzle needle 26 is made of stainless steel and formed in shape of a cylinder having a bottom. The nozzle needle 26 is provided at a front end thereof with the contact portion 26 to be seated or unseated on the valve seat 29*a*. The nozzle needle 26 has a small diameter column portion 26*d* on a downstream side of the fuel passage and a large diameter column portion 26*e* whose outer diameter is larger that that of the small diameter column portion 26*d* and which is held slidably by the small diameter cylindrical wall surface 29*d*. The contact portion 26 is formed in conical shape by chamfering an axial end circumferential periphery of the small diameter column portion 26*d* on a downstream side of the fuel passage. Consequently, a seat diameter, that is, outer diameter of the contact portion 26*c* is smaller that inner diameter of the small diameter cylindrical wall surface 29*d* slidably holding the nozzle needle 26. Accordingly, a seat surface of the valve seat 29*a* can be easily and precisely manufactured so that the contact portion 26*c* may come fluid-tightly in contact with the valve seat 29*a*. That is, after the small diameter cylindrical wall surface 29*d*, the conical surface 29*c*, the large diameter cylindrical wall surface 29*b* and the valve seat 29*a* are processed by machining, the seat surface of the valve seat 29*a* is easily surface finished by axially inserting a surface finish tool into the guide hole through an inside of the small diameter cylindrical wall surface 29*d* from the upstream of the fuel passage, since the seat diameter of the valve seat 29*a* is smaller that the inner diameter of the small diameter cylindrical wall surface 29*d*. An outer diameter of the large diameter column portion 26*e* is slightly smaller than the inner diameter of the small diameter cylindrical wall surface 29*d* so that the large diameter column portion 26*e* may slide on the small diameter cylindrical wall surface 29 with a given minute gap therebetween.

The large diameter column portion 26*e* is provided with an inner circumferential wall 26*a* whose inside constitutes an inner passage 26*f* through which fuel flows toward the downstream of the fuel passage. The inner passage 26*f* is formed axially by drilling deep into an inside of the large diameter column portion 26*e* from an end thereof on an upstream side of the fuel passage to an extent that a bottom of the nozzle needle 26 can endure a shock generated upon being seated on the valve seat 29*a*. The inner passage 26*f* makes the nozzle needle 26 lighter in weight, while strength of the nozzle needle 26 against the shock upon being seated on the valve seat 29*a* is sufficiently strong. Lighter weight of the nozzle needle 26 serves to increase response characteristic of the valve portion B.

The large diameter column portion 26*e* is provided on a downstream side of the inner passage 26*f* with at least an outlet hole 26*b* through which the inner passage 26*f* communicates with the fuel sump chamber 29*f*, that is, the valve seat 29*a* on a downstream side of the fuel passage.

An injection bore plate 28, which is formed in shape of a thin board, is disposed on the front end of the fuel injection valve 1. The injection bore plate 28 is provided in a center thereof with a plurality of injection bores 28*a*. Injection destination of fuel to be sprayed from the injection bores 28*a* is defined by inclination of each axis of the injection bores 28*a* and an arrangement position thereof. Injection amount of fuel to be sprayed from the injection bores 28*a* is defined by opening areas of the injection bores and an opening time period of the valve portion B to be driven by the electromagnetic drive portion S.

The electromagnetic drive portion S, which is composed of the coil 31, the metal inner pipe member 14, the attracting member 22, the metal outer frame members 18 and 23 and the armature 25, is operative to bring the valve portion B of the fuel injection valve 1 in a valve opening or closing state upon allowing or interrupting current supply to the coil 31.

As shown in FIG. 1, the coil 31 has the coil wound on an outer circumference of the spool 30 made of resign material. The coil 31 is provided at an end thereof with a terminal 12 for electric connection. The spool 30 is arranged around an outer circumference of the metal inner pipe member 14. The terminal 12 is embedded in a connector 16 protruding through a lib 17 out of an outer circumference of resign mold member 13 that is formed around the outer circumference of the metal inner pipe member 14.

The metal inner pipe member 14 is a composite pipe member having magnetic and non-magnetic material zones. The metal inner pipe member 14 is composed of a magnetic material pipe 14*a* (first zone), a non-magnetic material pipe 14*b* (third zone), whose material characteristic is changed by heating a part of the magnetic material zone, and a magnetic material pipe 14*c* (second zone). The armature 25 is slidably disposed in an armature accommodation hole 14*e* surrounded by the inner circumference 14*d* of the metal inner pipe member 14 across an axial boundary of the magnetic material pipe 14*c* and the non-magnetic material pipe 14*b*.

As shown in FIG. 1, the coil 31 is sandwiched radially between the metal outer frame members 18 and 23, which are covered with a mold resign member 15, and the metal inner pipe member 14, which form the magnetic circuit through which magnetic flux flows due to the electromagnetic force generated upon energizing the coil 31. One of the metal outer frame members 18 and 23 (second outer frame 23) covers the outer circumference of the coil 31 on a downstream side of the fuel passage and the other of the metal outer frame members 18 and 23 (first outer frame 18), which is formed in shape of a folding fan, covers the outer circumference of the coil 31 on an upstream side of the fuel passage except the lib 17. The mold resin member 15, which covers the first and second metal outer frames 18 and 23, is connected with the mold resin member 13.

The magnetic flux due to the electromagnetic force generated by the coil 31 passes through the magnetic material pipe 14*a*, the attracting member 22, the armature 25, the magnetic material pipe 14*c*, the second metal outer frame 23 and the first metal outer frame 18, which constitute the magnetic circuit.

The armature 25, which is made of ferromagnetic material such as magnetic stainless steel and formed in shape of a cylinder having a step, is fixed to the nozzle needle 26. When the coil 31 is energized, the magnetic flux acting on the armature 25 via the attracting member 22 causes the armature 25 together with the nozzle needle 26 to move axially toward the attracting member 25, that is, in a direction of moving apart from the valve seat 29*a*. An inner passage 25*e* of the armature 25 communicates with the inner passage 26*f* of the nozzle needle 26.

The armature 25 is provided on a surface thereof facing the attracting member 22 with a projection 25*d*, which comes in contact with the attracting member 22 in the valve opening state. The projection 25*d* serves to make a contact surface between the armature 25 and the attracting member 22 smaller so that, when the current supply to the coil 31 stops, the armature 25 is promptly de-magnetized, which results in improving response characteristic in the valve closing state.

The attracting member 22, which is made of ferromagnetic material such as magnetic stainless steel and formed in a pipe shape, is press fitted to the inner circumference 14*d* of the metal inner pipe member 14. As shown in FIG. 2, a valve lift amount La is defined by adjusting an axial position where the attracting member 22 is press fitted to the metal inner pipe member 14.

A biasing spring (compression spring) 24 is disposed in the inner passage 25*e* between an axial end of an adjusting pipe 21 arranged inside the attracting member 22 and a spring seat 25*c* that is a step provided in the inner passage 25*e* of the armature 25. The compression spring 24 urges with a given biasing force the nozzle needle 26 fixed to the armature 25 toward the valve body 29 so that the contact portion 26*c* of the nozzle needle 26 comes in contact with the valve seat 29*a* of the valve body 29, when the coil 31 is not energized.

The biasing force of the compression spring 24 is defined to a given value by adjusting a pressing stroke amount of the adjusting pipe 21 to be press fitted to an inner circumference 22*c* of the attracting member 22. Instead of the adjusting pipe 21 to be press fitted to the inner circumference 22*c* of the attracting member 22, the fuel injection valve 1 may have a modified adjusting pipe to be press fitted directly to the inner circumferential wall of the metal inner pipe member 14 within which the fluid passage is formed or to be screw fastened to the inner circumference 22*c* of the attracting member 22, as far as the modified adjusting pipe is arranged to adjust the biasing force acting on the nozzle needle 26 to be seated on the valve seat 29*a*.

The valve body 29 and the injection bore plate 28 are fluid-tightly fixed to the metal inner pipe member 14 on the most downstream side of the fuel passage. As an alternative, after the injection bore plate 28 is fluid-tightly bonded to the valve body 29 by welding, the valve body 29 may be fluid-tightly fixed to the metal inner pipe member 14. A filter 11 is disposed in the metal inner pipe member 14 on the most upstream side of the fuel passage. The filter 11 serves to eliminate foreign material contained in fuel flowing into the fuel injection valve 1.

The metal inner pipe member 14 fluid-tightly fixed to the valve body 29 may be interpreted as a part of the valve body 29, since the metal inner pipe member 14 together with the valve body 29 forms the guide hole in which the nozzle needle 26 is accommodated.

An operation of the fuel injection valve 1 is described below.

When the coil 31 of the electromagnetic drive portion S is energized, the coil 31 generates the electromagnetic force, which causes the armature 25 to be attracted toward the attracting member 22 so that the nozzle needle 26 leaves the valve seat 29*a* and is in the valve opening state. Accordingly, the fuel flowed into the fluid passage is sprayed via the inner passage 26*f* and the armature accommodation hole 14*e* and the injection bores 28*a* to the internal combustion engine.

When the coil 31 is de-energized, the electromagnetic force generated in the coil 31 disappears so that the force of attracting the armature 25 toward the attracting member 22 also disappears. Accordingly, the nozzle needle 26 is urged to seat on the valve seat 29*a* by the biasing force of the compression spring 24 acting on the armature 25 so that the nozzle needle 26 turns to the valve closing state to interrupt the fuel flowing out to the internal combustion engine. At this time, if the contact portion 26*c* of the nozzle needle 26 is fluid-tightly seated on the valve seat 29*a*, the fuel flow out is completely blocked.

The injection amount of fuel to be sprayed to the internal combustion engine is defined by controlling a time period during which the coil 31 is energized, that is, a time period during which the nozzle needle 29 is in the valve opening state.

To precisely adjust the injection amount of fuel to be sprayed to the internal combustion engine, it is necessary to secure adequate fluid-tightness of the valve portion B in the valve closing state, adequate response characteristic of the valve portion B in the valve opening and closing states and a valve lift amount necessary for a given amount of fuel to be injected from the injection bores 28*a*.

For example, under the presumption that both of the fluid-tightness of the valve portion B and the optimum response characteristic of the valve portion B have been adequately adjusted, it is necessary to adjust an axial position of the attracting member 22 for securing a maximum lift amount, that is, a valve lift amount La (refer to FIG. 2) corresponding to a distance by which the nozzle needle 26 is apart from the valve seat 29*a* in the valve opening state so that the fuel injection amount, in particular, maximum fuel injection amount as a nominal output may be adjusted.

To secure the adequate fluid-tightness of the valve portion B, the valve needle 26 and the valve body 29 have to be manufactured as component parts having accurate dimension to an extent that, when the contact portion 26*c* contacts the valve seat 29*a*, an clearance therebetween is fluid-tightly sealed. Further, to secure the adequate response characteristic of the valve portion B, the adjusting pipe 21 has to be positioned so as to achieve an adequate biasing force of the compression spring 24 that urges the nozzle needle 26 toward the valve seat 29*a*, that is, in a valve closing direction. The adjustment of the axial position of the attracting member 22 for defining the valve lift amount La is always necessary for accurately adjusting the fuel injection amount, though the adjustment for securing both of the fluid-tightness of the valve portion B and the optimum response characteristic of the valve portion B is not always necessary to satisfy required accuracy of the fuel injection amount.

When the attracting member 22 is press fitted into the inner circumference 14*d* of the metal inner pipe member 14, geometric or shape accuracy of the inner circumference 14*d* of the metal inner pipe member 14 largely affects on a value of the pressing load applied to the attracting member 22. Since the metal outer frame members 18 and 23 are press fitted or bonded to the outer circumference of the metal inner pipe member 14, the geometry of the inner circumference 14*d* of the metal inner pipe member 14 is likely variable. If the pressing load applied to the attracting member 22 varies, the axial position of the attracting member 22 for defining a target fuel injection amount is not stably defined so that the valve lift amount is not accurately adjusted.

It is preferable, therefore, that, even if the geometry of the inner circumference 14*d* of the metal inner pipe member 14 is variable, the valve lift amount is stably and accurately defined.

As shown in FIG. 3, the first metal outer frame member 18 and the second metal frame member 23 are provided respectively with a leading end portion 18*a* and a ring portion 23*a*, which are arranged around and press fitted to a first limited region J1 and a second limited region 23*a* of the outer circumference of the metal inner pipe member 14 which fall within the magnetic material pipe 14*a* and within the magnetic material pipe 14*c*, respectively. The leading end portion 18*a* and the ring portion 23*a* has to be connected to the first and second limited regions J1 and J2 so as to form a magnetic circuit composed of the metal frame members 18 and 23 and the metal inner pipe member 24 through which the magnetic flux generating upon energizing the coil 31 easily passes. The leading end portion 18*a* is formed in shape of a folding fan and surrounds the outer circumference of the metal inner pipe member 14 except the lib 17. The leading end portion 18*a* may be formed in any other shape such as a ring shape, as far as the shape of the leading end portion 18*a* is suitable for press fitting the first metal outer frame member 18 to the outer circumference of the metal inner pipe member 14.

The mold resin member 15 not only covers the outer circumferences of the metal outer frame members 18 and 23 but also is close fitted to the outer circumference of the metal inner pipe member 14 so that the metal outer frame members 18 and 23 are firmly connected to the metal inner pipe member 14.

As shown in FIG. 3, the metal inner pipe member 14 is provided on the outer circumference thereof with a step portion 14*f* which retains a front end face 18*b* of the first metal outer frame member 18, when the first metal outer frame member 18 is press fitted to the outer circumference of the metal inner pipe member 14, so that the coil 31 and the second metal outer frame member 23 are also retained through the first metal outer frame member 18 by the step portion 14*f*. Accordingly, the first metal outer frame member 18, the coil 31 and the second metal outer frame member 23 are easily press fitted to the metal inner pipe member 14 from the downstream of the fuel passage toward the upstream thereof.

An axial clearance La between the attracting member 22 and the armature 25 in a valve closing state of the valve portion B is defined by adjusting an axial position of the attracting member 22 relative to the metal inner pipe member 14, when the attracting member 22 is press fitted to the inner circumference 14*d* of the metal inner pipe member 14. That is, the axial clearance La is the maximum lift amount La in a valve opening state of the valve portion B.

The attracting member 22 is press fitted to the metal inner pipe member 14 beyond an axial boundary of the magnetic material pipe 14*a* (first zone) and the non-magnetic material pipe 14*b* (third zone) from the upstream of the fuel passage to the downstream thereof so that the axial end of the attracting member 14 is positioned axially within the non-magnetic pipe 14*b* (third zone) and the other axial end thereof is positioned axially within the magnetic material pipe 14*a* (first zone).

The first limited region J1 of the outer circumference of the metal inner pipe member 14, to which the first metal outer frame member 18 is connected, is positioned on the magnetic material pipe 14*a* (the first zone) axially between the axial end of the attracting member 22 and the other axial end thereof. The second limited region J2 of the outer circumference of the metal inner pipe member 14, to which the second metal outer frame member 23 is connected, is positioned on the magnetic material pipe 14*c* (the second zone) and an axial end of the armature 25 is position axially on the magnetic material pipe 14*c* (the second zone) and the other axial end thereof on a side of the attracting member 22 is positioned axially on the non-magnetic material pipe 14*b* (the third zone). Accordingly, when the coil 31 is energized, the magnetic flux passing through the first metal outer frame member 18 and the magnetic material pipe 14*a* of the metal inner pipe member 14 flows via the attracting member 22 and the armature 25 to the magnetic material pipe 14*c* of the metal inner pipe member 14 and the second metal outer frame member 23 without substantially flowing from the magnetic material pipe 14*a* to the magnetic material pipe 14*c* axially along the metal inner pipe member 14 since the non-magnetic material pipe 14*b* is axially interposed therebetween.

The inner circumference of the metal inner pipe member 14 is provided with a relief space R which prevents the outer circumference of the attracting member 22 from coming in contact with an inner circumference 14*g* of the metal inner pipe member 14 at least at a position just radially inside and axially corresponding to the first limited region J1.

The outer circumference of the attracting member 22 is in contact with the inner circumferences 14*d* of the magnetic material pipe 14*a* and the non-magnetic material pipe 14*b* only at a position axially between the first and second limited regions J1 and J2 and axially in a vicinity of the first limited region J1. Diameter of the inner circumference 14*g* of the metal inner pipe member 14 with which the outer circumference of the attracting member 22 is not in contact in the magnetic material pipe 14*a*(the first zone) is larger than that of the inner circumference 14*d* of the metal inner pipe member 14 with which the outer circumference of the attracting member 22 is in contact so that a radial space between the outer circumference of the attracting member 22 and the inner circumference 14*g* of the metal inner pipe member 14 constitutes the relief space R.

Even if the shape of the inner circumference 14*g* of the metal inner pipe member 14 radially inside and axially corresponding to the first limited region J1 is deformed when the first metal outer frame member 18 (the leading portion 18*a*) is press fitted to the first limited region J1 of the outer circumference of the metal inner pipe member 14, the relief space R absorbs the deformation so that the attracting member 22 can be precisely press fitted to the inner circumference of the metal inner pipe member 14 without unpredictable variation of the pressing force in order to accurately adjust the maximum lift amount La.

Since the inner circumference 14*g* of the metal inner pipe member 14 whose diameter is larger than that of the inner circumference 14*d* of the metal inner pipe member 14 extends axially from the first limited region J1 toward the upstream side of the fuel passage, the attracting member 22 is easily press fitted to the metal inner pipe member 14.

Figure 4:
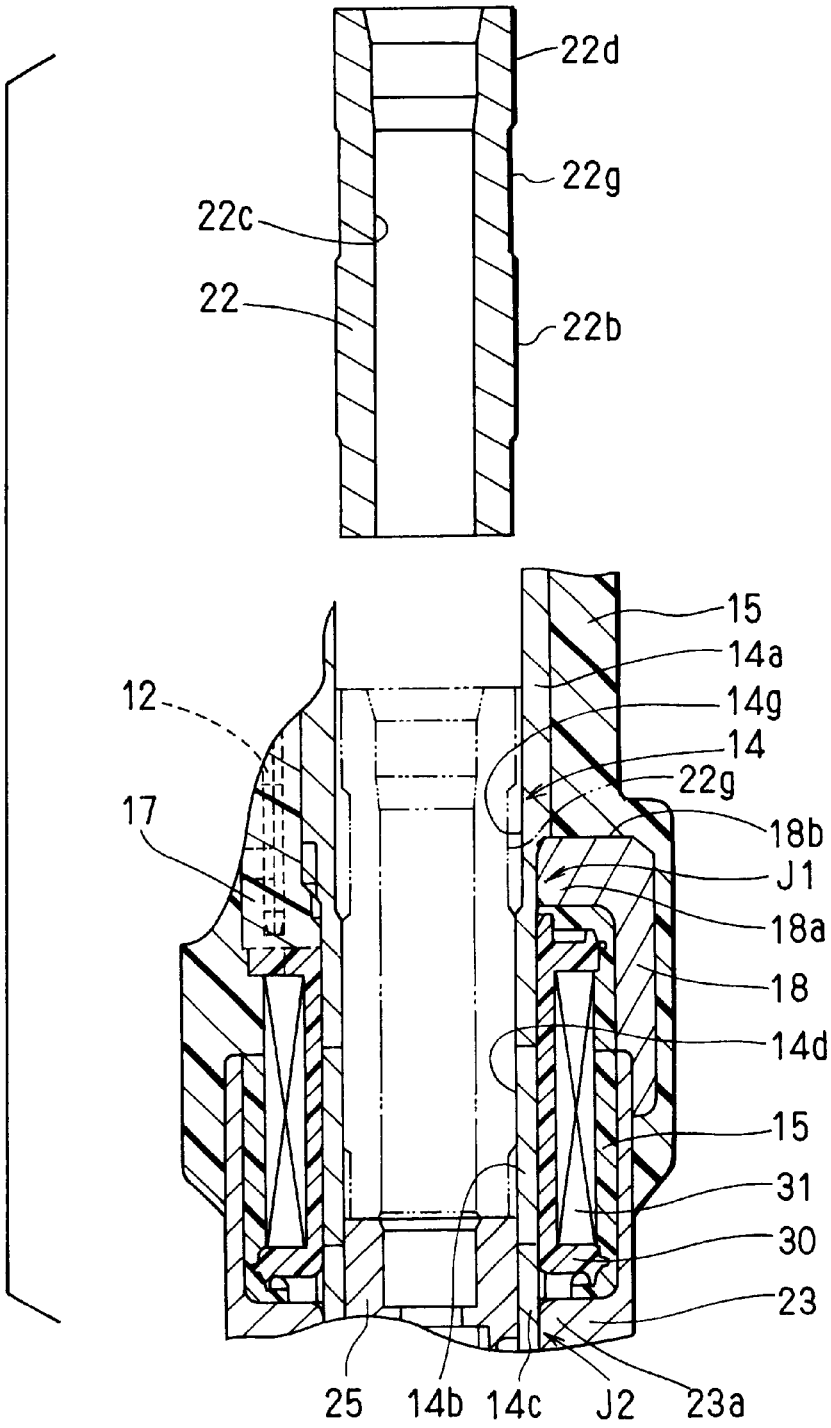
FIG. 4 is an exploded cross sectional part view of a fuel injection valve showing an attracting member and a metal inner pipe before the attracting member is press fitted to the metal inner member according a modification of the first embodiment.

As shown in FIG. 4, the attracting member 22 may be provided at a position axially corresponding to the first limited region J1 with another relief space R formed by an annular recess 22*g* in shape of an annular groove or a small diameter portion. In addition to the relief space R formed by the inner circumference 14*g* of the metal inner pipe member 14 extending up to a position axially corresponding to the first limited region J1, the another relief space R formed by the annular recess 22*g* serves to definitely avoid a possible contact between the outer circumference of the attracting member 22 and the inner circumference 14*g* of the metal inner pipe member 14 at the position axially corresponding to the first limited region J1.

Figure 5:
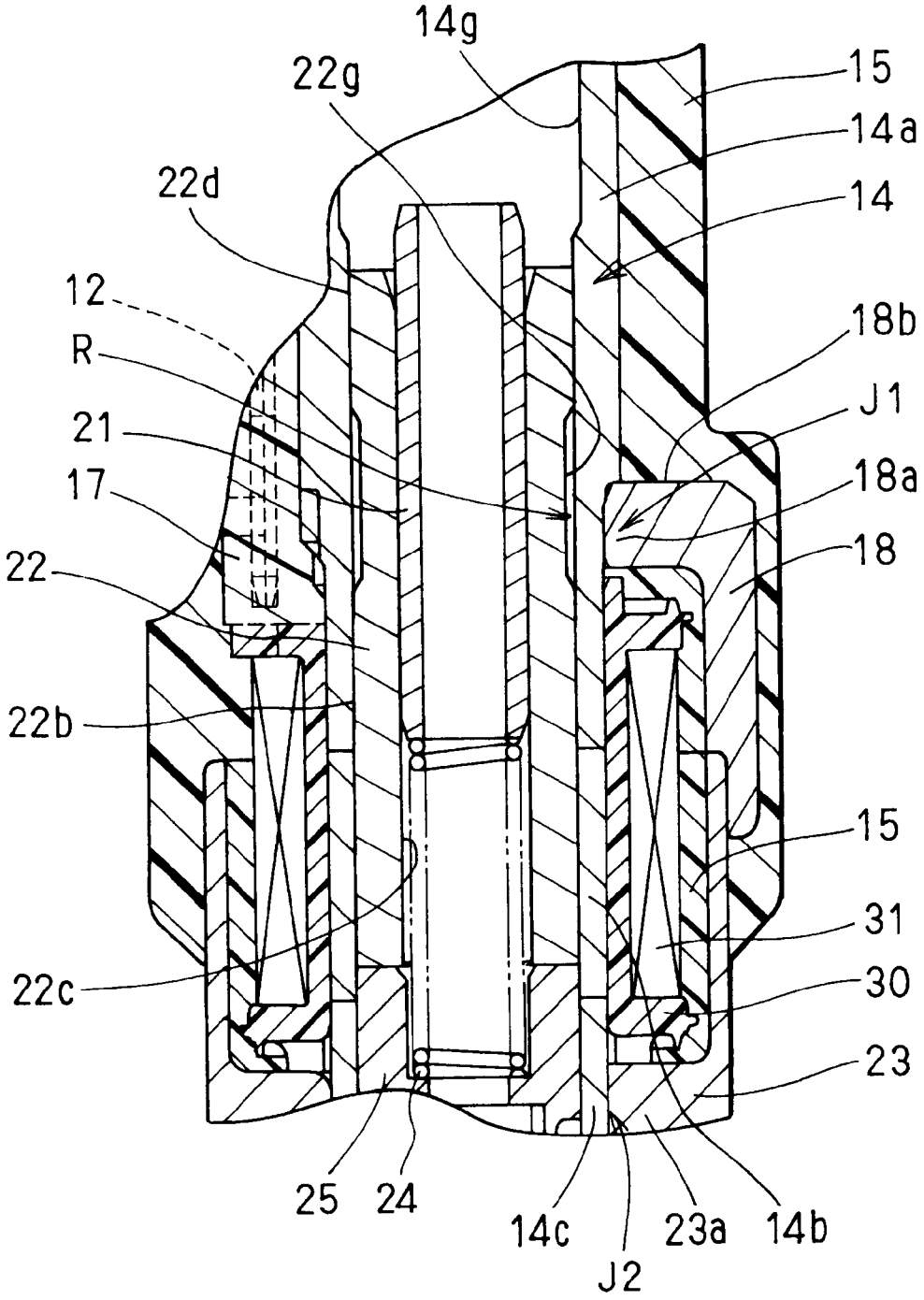
FIG. 5 is a cross sectional part view of a fuel injection valve showing an attracting member press fitted to a metal inner pipe member for defining a lift amount of the valve member according to another modification of the first embodiment.
Figure 6:
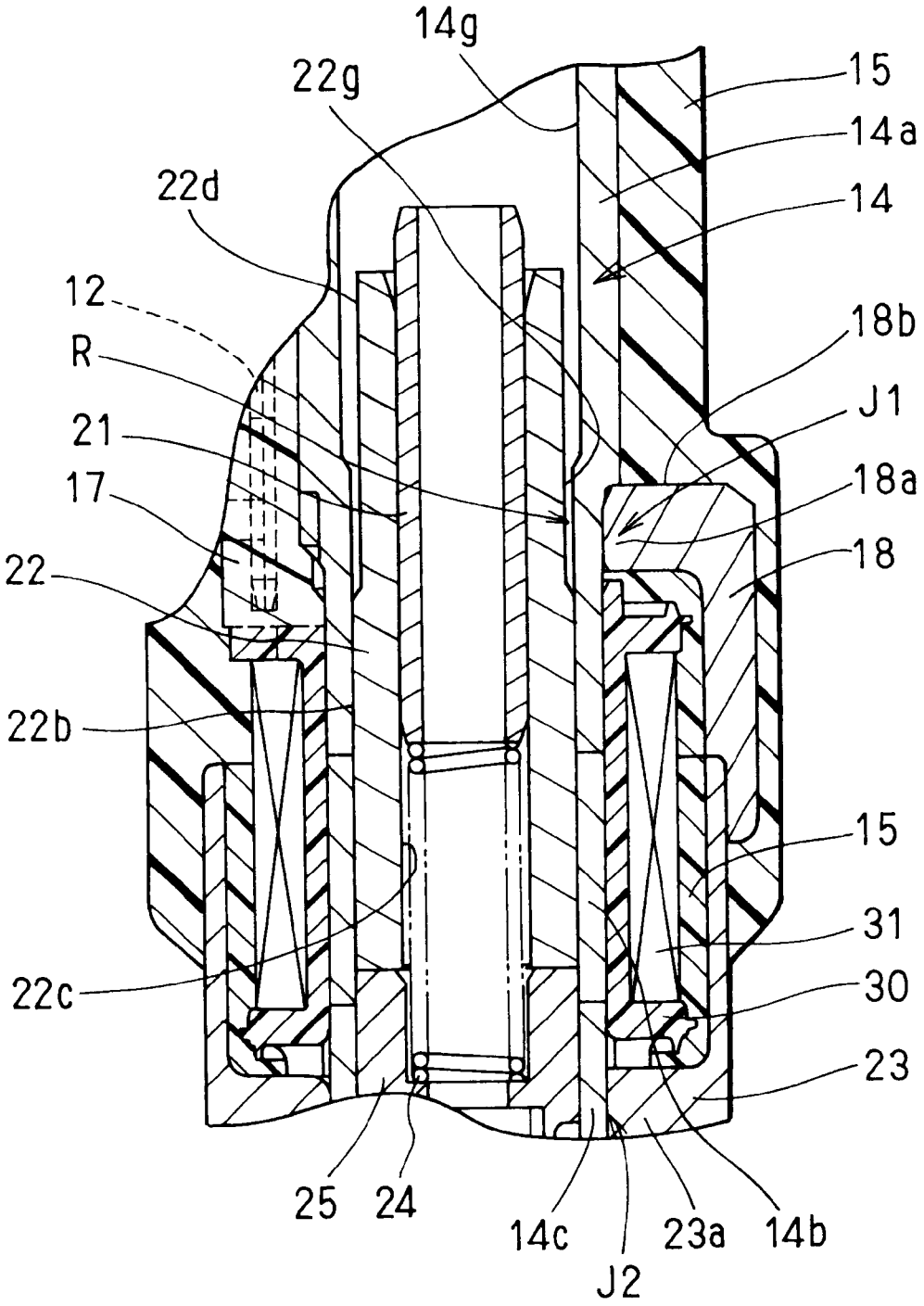
FIG. 6 is a cross sectional part view of a fuel injection valve showing an attracting member press fitted to a metal inner pipe member for defining a lift amount of the valve member according to a further modification of the first embodiment.

Further, as shown in FIGS. 5 and 6, in a case that the inner circumference 14*g* of the metal inner pipe member 14 extends before a position axially corresponding to the first limited region J1 and does not serve as the relief space R, the attracting member 22 may be provided at a position axially corresponding to the first limited region J1 with a relief space R formed by an annular recess 22 in shape of an annular groove (in FIG. 5) or a small diameter portion (in FIG. 6) which prevents the outer circumference of the attracting member 22 from coming in contact with the inner circumference 14*f* of the inner pipe member 22 at a position just radially inside and axially corresponding to the first limited region J1. Even if the inner circumference 14*g* of the metal inner pipe member 14 does not extend to the position axially corresponding to the first limited region J1, the annular recess 22*g* serves as the relief space R having the same advantage as the relief space R formed by the inner circumference 14*g* of the metal inner pipe member 14 extending up to the position axially corresponding to the first limited region J1.

Furthermore, the adjusting pipe 21 is press fitted to an inner circumference 22*c* of the attracting member 22 and the spring 24 is disposed at least partly within the inner circumference 22*c* of the attracting member 22 and sandwiched axially between the armature 25 and the adjusting pipe 21 for urging the armature 25 axially in a direction away from the attracting member 22. In this case, if the relief space R provided on the outer circumference of the attracting member 22 is positioned axially in a middle of the adjusting pipe 21 press fitted to the inner circumference 14*d* and diameters of the outer circumference of the attracting member 22 axially outside the relief space R are equal to each other, the relief space R not only prevents the outer circumference of the attracting member 22 from coming in contact with the inner circumference of the inner pipe member 14 at a position axially corresponding to the first limited region J1 but also serves to keep an adequate stiffness of the attracting member 22 so that the adjusting pipe 21 is precisely press fitted to the inner circumference of the attracting member 22.

Further, the resin mold member 15 is connected to the outer circumference of the metal inner pipe member 14 so as to cover the coil 31 and the metal outer frame members 18 and 23. Inner circumferences of the metal outer frame members 18 and 23 (the leading portion 18*a* and the ring portion 23*a*) connected to the outer circumference of the metal inner pipe member 14, an inner circumference of the coil 31 (the bobbin 30) around the outer circumference of the metal inner pipe member 14 and an inner circumference of the resin mold member 15 connected to the outer circumference of the metal inner pipe member 14 are concentrically arranged. Accordingly, the metal outer frame members 18 and 23, the coil 31 and the resin mold member 15 are integrally press fitted to the outer circumference of the metal inner pipe member 14, which results in reducing the manufacturing cost.

(Second embodiment)

Figure 7:
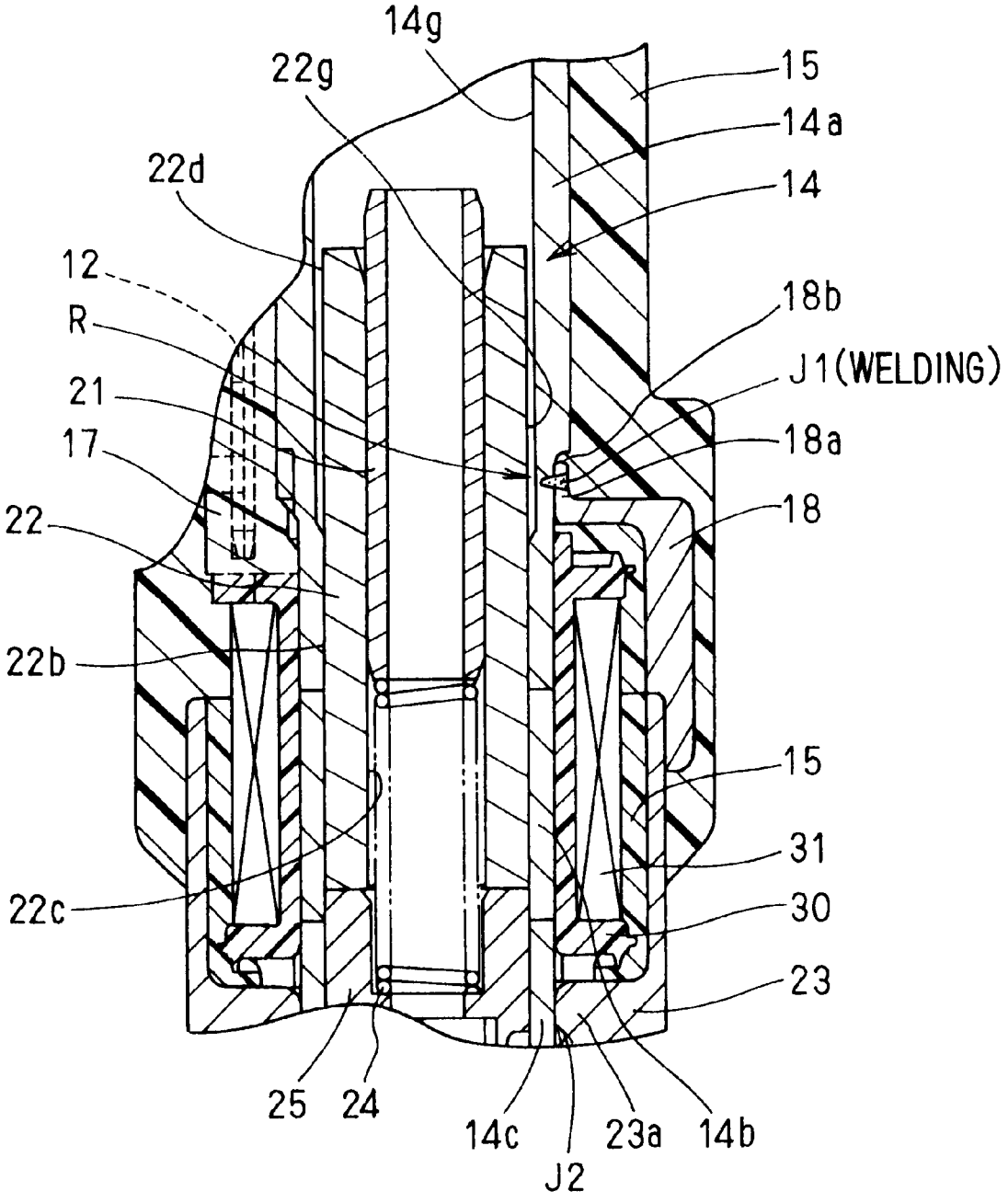
FIG. 7 is across sectional part view of a fuel injection valve showing an attracting member press fitted to a metal inner pipe member for defining a lift amount of the valve member according to a second embodiment of the present invention.

As shown in FIG. 7, in a fuel injection valve 1 according to a second embodiment, the first and second metal outer frame members 18 and 23 are bonded by welding to the first and second limited regions J1 and J2, instead of press fitting thereto as disclosed in the first embodiment. In this case, the inner circumferences of the metal inner pipe member 14 at apposition axially corresponding to the first and second limited regions J1 and J2 are prone to be deformed by thermal stress due to the welding. The relief space R is provided on the outer circumference of the attracting member 22 and/or the inner circumference 14*g* of the metal inner pipe member 14 in the similar way as disclosed in the first embodiment. Accordingly, the relief space R absorbs the possible deformation of the inner circumference of the metal inner pipe member 14 so that, when the attracting member 22 is press fitted to the metal inner pipe member 14, the outer circumference of the attracting member 22 does not contact the inner circumference 14*d* of the metal inner pipe member 14 at a position axially corresponding to the first limited region J1.

What is claimed is:

1. A valve for injecting fuel according to an axial reciprocal movement of a valve member, comprising:

an inner pipe member having first and second zones through which magnetic flux easily passes and a third zone through which magnetic flux hardly passes, the third zone being positioned axially between the first and second zones;

a drive coil arranged around an outer circumference of the inner pipe member;

an outer frame member connected to an outer circumference of the inner pipe member at first and second limited regions falling within the first and second zones, respectively, in such a manner that the drive coil is sandwiched radially between the outer frame member and the inner pipe member;

an attracting member press fitted to an inner circumference of the metal inner pipe member, an axial end of the attracting member being positioned axially within the third zone and other axial end thereof being positioned axially within the first zone;

a moveable member with an axial end that is connected to the valve member, accommodated to move axially and reciprocatingly within the inner circumference of the inner pipe member, said axial end of the moveable member being positioned axially within the second zone and other axial end thereof being positioned axially within the third zone so that the movable member is axially away by a given distance from the axial end of the attracting member, when the drive coil is not energized, and attracted toward the axial end of the attracting member by magnetic flux flowing through the outer frame member, the first zone, the movable member and the second zone, when the drive coil is energized, wherein at least one of an outer circumference of the attracting member and the inner circumference of the inner pipe member is provided with a relief space which prevents the outer circumference of the attracting member from coming in contact with the inner circumference of the inner pipe member at a position just radially inside and axially corresponding to the first limited region.

2. A device according to claim 1, wherein the outer frame member is bonded by welding at least to the first limited region.

3. A device according to claim 1, wherein the outer frame member is press fitted at least to the first limited region.

4. A device according to claim 3, further comprising:

a resin member connected to the outer circumference of the inner pipe member so as to cover the drive coil and the outer frame member, wherein an inner circumference of the outer frame member connected to the outer circumference of the inner pipe member, an inner circumference of the drive coil around the outer circumference of the inner pipe member and an inner circumference of the resin member connected to the outer circumference of the inner pipe member are concentrically arranged.

5. A device according to claim 1, wherein the outer circumference of the attracting member is in contact with the inner circumference of the inner pipe member only at a position axially between the first and second limited regions.

6. A device according to claim 5, wherein diameter of the inner circumference of the inner pipe member with which the outer circumference of the attracting member is not in contact in the first zone is larger than that of the inner circumference of the inner pipe member with which the outer circumference of the attracting member is in contact.

7. A device according to claim 6, wherein the attracting member is provided on and along the outer circumference thereof with an annular recess radially facing the inner circumference of the inner pipe member at a position radially inside and axially corresponding to the first limited region.

8. A device according to claim 1, wherein the attracting member is provided on and along the outer circumference thereof with an annular recess radially facing the inner circumference of the inner pipe member at a position radially inside and axially corresponding to the first limited region.

9. A device according to claim 1, wherein the attracting member is formed in a pipe shape, further comprising:

an adjusting pipe press fitted to an inner circumference of the attracting member; and a spring disposed at least partly within the inner circumference of the attracting member and sandwiched axially between the movable member and the adjusting pipe for urging the movable member axially in a direction away from the attracting member, wherein the outer circumference of the attracting member has the relief space, an outer circumference of the adjusting pipe is press fitted to the inner circumference of the attracting member axially across the relief space and diameter of the outer circumference of the attracting member axially beyond the relief space is equal to that axially before the relief space.

10. A device according to claim 9, wherein the relief space is at a position corresponding to an axial middle of the adjusting pipe.

* * * * *